US010006324B2

(12) United States Patent
Youm

(10) Patent No.: US 10,006,324 B2
(45) Date of Patent: Jun. 26, 2018

(54) PREVENTING APPARATUS FOR CONCENTRATING OIL OF VEHICLE

(71) Applicant: Hyundai Motor Company, Seoul (KR)

(72) Inventor: Chul Jun Youm, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 66 days.

(21) Appl. No.: 15/230,544

(22) Filed: Aug. 8, 2016

(65) Prior Publication Data

US 2017/0276037 A1 Sep. 28, 2017

(30) Foreign Application Priority Data

Mar. 22, 2016 (KR) ..... 10-2016-0034279

(51) Int. Cl.
*F01M 11/00* (2006.01)

(52) U.S. Cl.
CPC ... *F01M 11/0004* (2013.01); *F01M 2011/005* (2013.01); *F01M 2011/0037* (2013.01)

(58) Field of Classification Search
CPC ..... F01M 11/0004; F01M 2011/0037; F01M 2001/005
See application file for complete search history.

(56) References Cited

U.S. PATENT DOCUMENTS 2,938,601 A * 5/1960 Brafford ..... F01M 11/0004 184/103.1
6,845,743 B1 * 1/2005 Bishop ..... F01M 11/0004 123/195 C
7,069,899 B1 * 7/2006 Okuda ..... F01M 11/0004 123/195 C
9,353,851 B2 * 5/2016 Kubota ..... F16H 57/0404
9,551,247 B2 * 1/2017 Michel ..... F01M 11/064
9,677,436 B2 * 6/2017 Mordukhovich .. F01M 11/0004
2003/0029412 A1 * 2/2003 Kato ..... F01M 5/02 123/195 C
2005/0279314 A1 * 12/2005 Hada ..... F01M 11/0004 123/192.1
2008/0066982 A1 * 3/2008 Kobayashi ..... F01M 5/001 180/69.1
2009/0145695 A1 * 6/2009 Hiramatsu ..... F01M 11/0004 184/106
2015/0300220 A1 * 10/2015 Mordukhovich .. F01M 11/0004 184/106

FOREIGN PATENT DOCUMENTS

| | | |
|---|---|---|
| JP | 2015-107709 | 6/2015 |
| KR | 10-1998-0056321 | 9/1998 |
| KR | 10-1999-0058229 | 7/1999 |
| KR | 10-2002-0013095 A | 2/2002 |
| KR | 10-2012-0004220 | 1/2012 |
| KR | 10-2014-0042483 A | 4/2014 |

* cited by examiner

*Primary Examiner* — Michael A Riegelman
(74) *Attorney, Agent, or Firm* — Brinks Gilson & Lione

(57) ABSTRACT

A preventing apparatus for concentrating oil of a vehicle includes: a chamber disposed in an oil pan to enclose the surrounding of an oil strainer and having both sides provided with through holes through which oil inflows and outflows; and an oil blocking module disposed to be spaced apart from the through holes in the chamber and operated in an opposite direction to a turning direction of the vehicle when the vehicle turns in order to block one of the through holes of the chamber.

7 Claims, 3 Drawing Sheets

PREVENTING APPARATUS FOR CONCENTRATING OIL OF VEHICLE

CROSS REFERENCE TO RELATED APPLICATION

The present application claims priority to and the benefit of Korean Patent Application No. 10-2016-0034279, filed on Mar. 22, 2016, the entire contents of which is incorporated herein by reference.

FIELD

The present disclosure relates to an apparatus for inhibiting or preventing concentration of oil in an oil pan of a vehicle.

BACKGROUND

The statements in this section merely provide background information related to the present disclosure and may not constitute prior art.

Generally, oil needs to be supplied to a piston or a connecting rod which are parts configuring an engine of a vehicle, a valve adjust, and friction parts like bearings of each part for a smooth operation.

Therefore, an oil pan of which the upper portion is open is disposed at a lower portion of the engine to store oil and when the engine operates, an oil pump receiving power from a crank shaft is operated to supply the oil in the oil pan to each friction part.

The inside of the oil pan is provided with a suction pipe connected to an oil suction portion of the oil pump and a lower end of an oil pipe is connected to an oil strainer into which oil is sucked.

However, in the case of the existing oil pan, when a vehicle quickly turns or drives on a sloping road, the oil in the oil pan is concentrated to one side and therefore air is introduced into the oil strainer or oil is not supplied, such that an engine burning phenomenon may occur.

The contents described as the related art have been provided only for assisting in the understanding for the background of the present disclosure and should not be considered as corresponding to the related art known to those skilled in the art.

SUMMARY

The present disclosure provides an apparatus for inhibiting or preventing concentration of oil of a vehicle, which is capable of inhibiting or preventing air from being introduced into an oil strainer or oil from being not supplied by inhibiting or preventing oil in an oil pan to being concentrated to one side.

According to one form of the present disclosure, a preventing apparatus for concentrating oil of a vehicle includes: a chamber disposed in an oil pan to enclose the surrounding of an oil strainer and having both sides provided with through holes through which oil inflows and outflows; and an oil blocking module disposed to be spaced apart from the through holes in the chamber and operated in an opposite direction to a turning direction of the vehicle when the vehicle turns to block one of the through holes of the chamber.

The chamber may be a rectangular plate disposed to enclose the oil strainer in all directions.

The oil blocking module may include: a plurality of rails having both ends fixedly disposed at both sides of the chamber; a plurality of stopping members having both ends movably inserted into the rails and formed to block the through holes when moving to ends of the rails; and a plurality of elastic members inserted into the rails and disposed between both sides of the chamber and the stopping members, respectively, to provide an elastic force.

The stopping members may be subject to a force to be moved in an opposite direction to a turning direction of the vehicle when the vehicle turns and the elastic members may be compressed when the stopping members are subject to the force to be moved in the opposite direction more than the set value.

The rails may be provided in the chamber in parallel with each other.

The stopping members may have a plate shape and both ends of the stopping members may be provided with coupling holes inserted into the rails and a central portion thereof may be provided with a protrusion to block the through holes.

The protrusion may be provided to have a cross section reduced toward the chamber, and a cross section of the protrusion adjacent a body plate of the stopping members may be formed to be larger than an area of one of the through holes, and a cross section of the protrusion near the through holes may be formed to be smaller than the area of one of the through holes.

A stopper may protrude from the rail to prevent each of the stopping members from moving beyond the set distance from both sides of the chamber.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
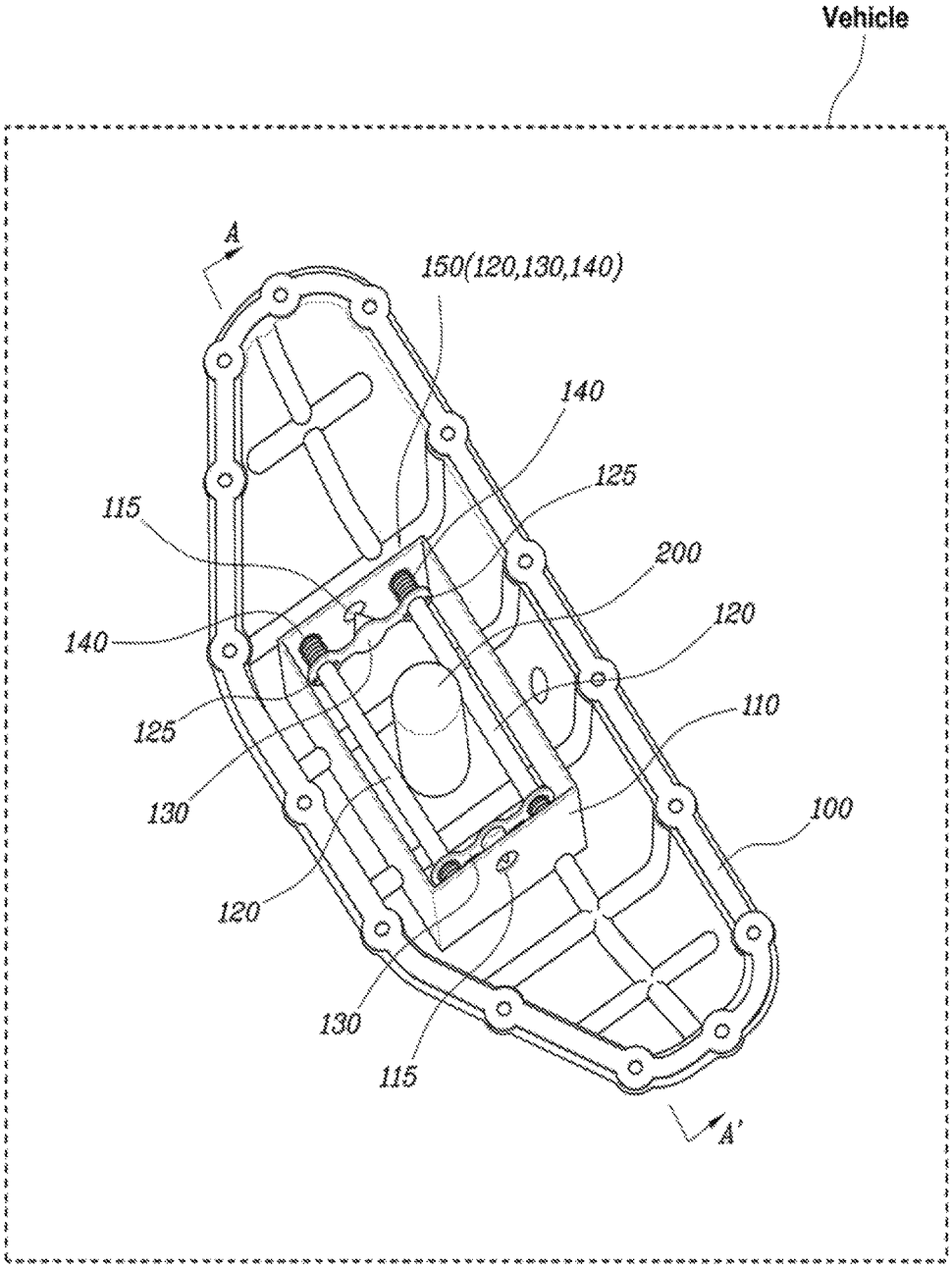
FIG. 1 is a perspective view illustrating a preventing apparatus for concentrating oil of a vehicle.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
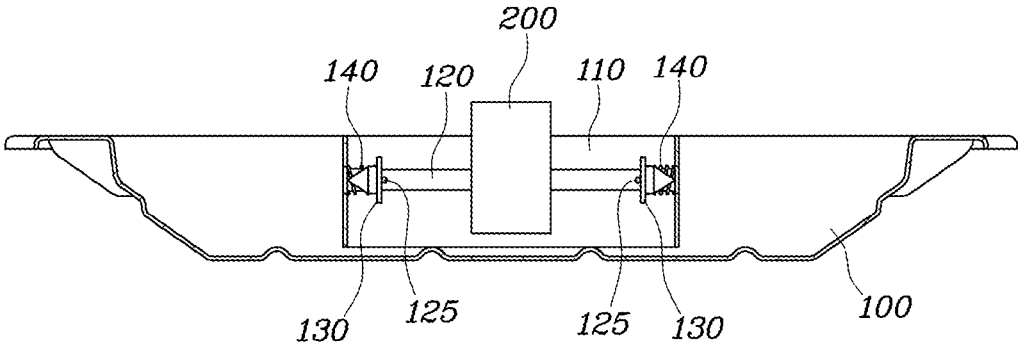
FIG. 2 is a cross sectional view of the preventing apparatus for concentrating oil of a vehicle.

Referring to FIGS. 1 and 2, the preventing apparatus for concentrating oil of a vehicle according to one form of the present disclosure may include: a chamber 110 disposed in an oil pan 100 to enclose the surrounding of an oil strainer 200 and having both sides provided with through holes 115 through which oil inflows and outflows; and an oil blocking module 150 disposed to be spaced apart from the through holes 115 in the chamber 110 and operated in an opposite direction to a turning direction of the vehicle when the vehicle turns in order to block one of the through holes 115 of the chamber 110.

The oil pan 100 is provided at a lower portion of an engine in a state in which an upper portion of the oil pan 100 is open to store oil and an oil pump operated by the engine serves to suck the oil in the oil pan 100 through the oil strainer 200 to supply oil to parts of the vehicle desired for lubrication.

The chamber 110 is disposed in the oil pan 100 and is a rectangular plate disposed to enclose the oil strainer 200 in all directions.

That is, according to the related art, when the vehicle turns at a high speed or a road surface is inclined horizontally, an inlet of the oil strainer 200 is not dipped in oil due to an oil concentrating phenomenon inside the oil pan 100 and therefore air is introduced into the oil pump or oil is not supplied. On the other hand, according to the present technology, a separate space is formed around the oil strainer 200 by the chamber 110 and oil inflows and outflows into and from the chamber 110 only through the through holes 115, such that the oil strainer 200 maintains being dipped in oil in the chamber 110.

In particular, the oil blocking module 150 is provided in the chamber 110. For example, when a vehicle turns at a high speed or drives on a road surface inclined horizontally and thus the oil in the oil pan 100 is concentrated to one side, the oil blocking module 150 is operated to block the through hole 115 in a direction in which oil is concentrated, thereby preventing the oil in the chamber 110 from exiting through the through hole 115. Therefore, a height of an oil level in the chamber 110 may be maintained, and as a result the inlet of the oil strainer 200 may keep dipping in oil.

In detail, the oil blocking module 150 includes a plurality of rails 120 having both ends fixedly disposed at both sides of the chamber 110, a plurality of stopping members 130 having both ends movably inserted into the rails 120 and configured to block the through holes 115 when moving to ends of the rails 120, and a plurality of elastic members 140 inserted into the rails 120 and disposed between both sides of the chamber 110 and the stopping members 130, respectively, to provide an elastic force.

That is, the stopping member 130 serves to open and close the through hole 115 of the chamber 110 while moving horizontally along the rails 120 fixed at both sides of the chamber 110. In this case, the stopping member 130 moves to a direction in which oil is concentrated to block the through hole(s) 115 of in a corresponding position.

Further, an elastic member 140 of an elastic material is disposed between the chamber 110 and the stopping members 130 to allow the stopping members 130 to be spaced apart from the through hole 115 of the chamber 110 by a set interval at ordinary times, such that oils in the oil pan 100 may freely inflow and outflow into and from the chamber 110.

Meanwhile, the stopping members 130 are subject to a force to be moved in an opposite direction to a turning direction of the vehicle when the vehicle turns and the elastic members 140 are disposed to be compressed when the stopping members 130 are subject to the force to be moved in the opposite direction more than the set value.

If the vehicle turns at a high speed, the stopping member 130 is subject to the force to be moved in an opposite direction to a turning direction of the vehicle by inertia and the elastic member 140 may be provided with a compression spring having a strength easily compressed by the force transferred to the stopping member 130. Therefore, the stopping member 130 moves to the direction in which oil is concentrated by the inertia to block the through hole 115, thereby inhibiting or preventing the oil in the chamber 110 from being discharged to the outside through the through holes 115 provided in the concentrating direction.

Meanwhile, the set value may be set to be changed depending on the strength of the elastic member 140.

In the present technology, the rails 120 may be provided in the chamber 110 in parallel with each other, such that the stopping member 130 may straightly move horizontally along the rails 120.

Figure 3:
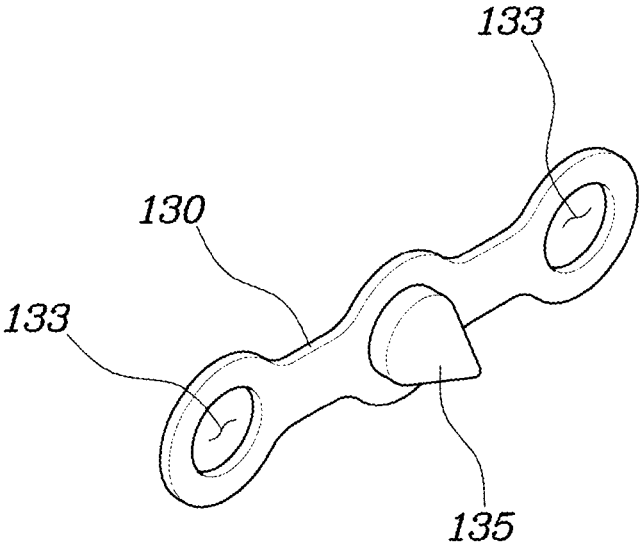
FIG. 3 is a diagram illustrating in detail a stopping member.

FIG. 3 is a diagram illustrating in detail the stopping member of the present disclosure. Referring to FIG. 3, the stopping member 130 has a plate shape and both ends of the stopping member 130 may be provided with coupling holes 133 inserted into the rails 120 and a central portion thereof may be provided with a protrusion 135 to block the through hole 115.

Here, the protrusion 135 protrudes from one side surface of the stop member 130 toward the through hole 115, and the location of protrusion 135 is determined based on the location of the through hole 115 of the chamber so as to block the through hole 115. The stopping members 130 may be installed one or both sides of the rails 120 as illustrated in FIGS. 1 and 2. When the stopping members 130 are provided on each end side of the rails 120, the protrusions 135 extending from the central portion of the stopping member 130 each protrude in an opposite direction each other (i.e., protruding toward the corresponding through holes 115).

Meanwhile, the protrusion 135 is provided to have a cross section reduced toward the chamber 110. The cross section of the protrusion 135 adjacent to the plate (i.e., the body plate of the stopping member 130) is formed to be larger than an area of the through hole 115 and the cross section of the protrusion 135 near the through hole 115 is formed to be smaller than the area of the through hole 115.

That is, if the stopping member 130 moves to approach the through hole 115 of the chamber 110, the area of the protrusion 135 inserted into the through hole 115 is increased depending on a moving distance, and as a result, at some point, the cross section of the protrusion 135 becomes substantially equal to the size of the through hole 115. In this situation, the through hole 115 is blocked by the protrusion 135 and thus does not allow the oil in the chamber 110 to be discharged to the outside due to the concentrating phenomenon.

In one form, the through hole 115 has a circular shape, and the protrusion 135 has a conical shape and may protrude from the stopping member 130. However, this is only one form and therefore they may have various shapes such as a rectangular shape.

Further, a stopper 125 may protrude from the rail 120 to prevent each of the stopping members 130 from moving beyond the set distance from both sides of the chamber 110.

That is, if the stopping member 130 excessively moves to the opposite side of the through hole 115 along the rail 120 by the elastic member 140, the time to stop the through hole 115 upon the occurrence of the oil concentrating phenomenon may be delayed. Therefore, the stopper 125 may be formed on the rail 120 to prevent the stopping members 130 from being far way from the through hole 115 beyond the set distance. In this case, the stopper 125 is provided to be larger than a width of the coupling hole 133 of the stopping member 130 to prevent the stopping member 130 from moving along the rail 120 beyond the set distance.

Figure 4:
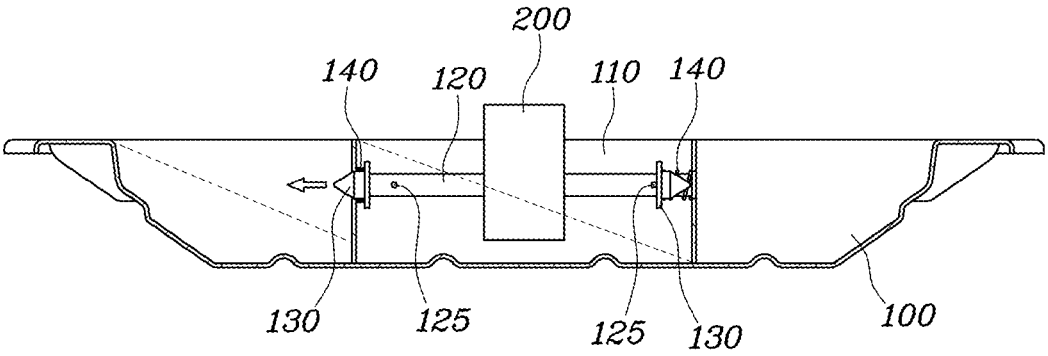
FIG. 4 is a cross sectional view illustrating an operation of the preventing apparatus for concentrating oil of a vehicle when oil is concentrated left.
Figure 5:
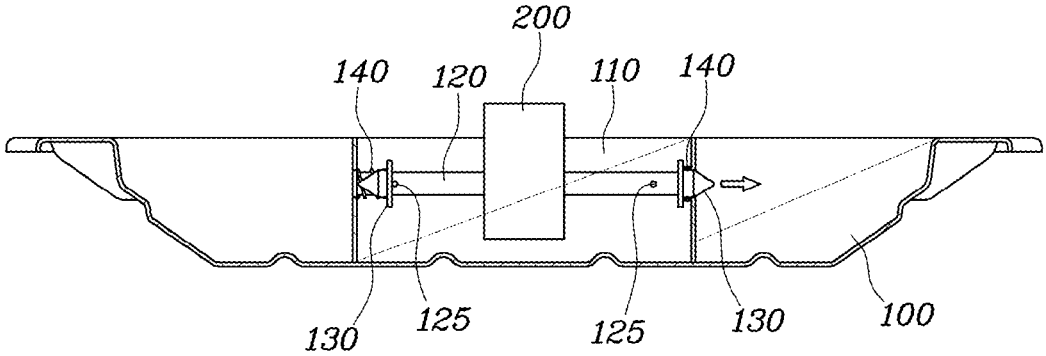
FIG. 5 is a cross sectional view illustrating the operation of the preventing apparatus for concentrating oil of a vehicle when oil is concentrated right.

FIG. 4 is a cross sectional view illustrating an operation of the preventing apparatus for concentrating oil of a vehicle when oil is concentrated left according to one form of the present disclosure, and FIG. 5 is a cross sectional view illustrating the operation of the preventing apparatus for concentrating oil of a vehicle when oil is concentrated right.

According to the present technology, when a vehicle turns right at a high speed or is driving on a road surface inclined to the left, the oil in the oil pan 100 is concentrated to the left. As illustrated in FIG. 4, the elastic member 140 provided at the left is compressed by the inertia to move the stopping member 130 to the left, thereby blocking the through hole and although the elastic member 140 provided at the right is stretched, the stopping member 130 is fixed by the stopper 125. Due to this, the oil concentration occurs to the left, but the oil in the chamber 110 does not exit but the chamber 110 is rather supplied with oil from the right through hole, such that the oil strainer 200 may keep being dipped in the oil.

On the other hand, when a vehicle turns left at a high speed or is driving on a road surface inclined to the right, as illustrated in FIG. 5, the elastic member 140 provided at the right is compressed to move the stopping member 130 to the right, thereby blocking the through hole. Although the elastic member 140 at the opposite side is stretched, the stopping member 130 and the through hole are excessively maintained at the set distance by the stopper 125. As a result, when the oil concentration occurs to the right, the oil in the chamber 110 is inhibited or prevented from being discharged to the right through hole and the chamber 110 is supplied with oil from the left through hole, such that the oil strainer 200 may maintain being dipped in the oil.

According to the preventing apparatus for concentrating oil of a vehicle having the foregoing structure, it is possible to inhibit or prevent the engine burning phenomenon by stably supplying the engine oil through the oil pump by inhibiting or preventing the oil in the oil pan from being concentrated to one side when the vehicle rotates at a high speed.

Although the present disclosure has been shown and described with respect to specific exemplary forms, it will be obvious to those skilled in the art that the present disclosure may be variously modified and altered without departing from the spirit and scope of the present disclosure.

What is claimed is:

1. A preventing apparatus for concentrating oil of a vehicle, comprising:

a chamber disposed in an oil pan and configured to surround an oil strainer, the chamber defined by a plurality of plates including first and second plates, wherein the first and second plates are facing to each other and each provided with one or more through holes through which the oil flows in and out of the chamber; and an oil blocking module disposed in the chamber, wherein the oil blocking module includes:

a plurality of rails each having a first end and a second end, wherein the first ends of the plurality of rails are fixedly disposed on the first plate, and the second ends of the plurality of rails are fixedly disposed on the second plate;

a plurality of stopping members including first and second stopping members each movably coupled to the corresponding rail of the plurality of rails and configured to slide along the corresponding rail; and a plurality of elastic members configured to provide elastic force and including a first elastic member disposed between the first plate and the first stopping member, and a second elastic member disposed between the second plate and the second stopping member, wherein the first stopping member is configured to close the one or more through holes formed in the first plate when the oil pushes the first stopping member toward the first plate when the vehicle turns in one direction, and the second stopping member is configured to close the one or more through holes formed in the second plate when the oil pushes the second stopping member toward the second plate when the vehicle turns in other direction.

2. The preventing apparatus of claim 1, wherein the first and second stopping members are subject to a force to be moved in an opposite direction to the turning direction of the vehicle when the vehicle turns, and the first and second elastic members are compressed when the first and second stopping members are subject to the force to be moved in the opposite direction more than a set value.

3. The preventing apparatus of claim 1, wherein the plurality of rails are parallel to each other and provided in the chamber.

4. The preventing apparatus of claim 1, wherein the first and second stopping members each have first and second ends provided with coupling holes configured to receive the corresponding rails, and a central portion of the first and second stopping members is provided with a protrusion to block the through holes.

5. The preventing apparatus of claim 4, wherein the protrusion is projected from the central portion and tapered toward the one or more through holes.

6. The preventing apparatus of claim 5, wherein a cross section of the protrusion adjacent the central portion of the stopping members is formed to be larger than an area of one of the through holes, and a cross section of the protrusion near the through holes is formed to be smaller than the area of one of the through holes.

7. The preventing apparatus of claim 1, wherein the plurality of rails includes a stopper formed on a surface of the rails to prevent each of the first and second stopping members from moving beyond a set distance measured from the first ends and second ends of the rails, respectively.

* * * * *